United States Patent [19]

Pfaffle

[11] 4,178,972

[45] Dec. 18, 1979

[54] MACHINE FOR MANUFACTURING ZIG ZAG WIRE BINDERS

[75] Inventor: Ernst Pfaffle, Neuffen, Fed. Rep. of Germany

[73] Assignee: Hans Sickinger Co., Pontiac, Mich.

[21] Appl. No.: 933,677

[22] Filed: Aug. 14, 1978

[51] Int. Cl.[2] ..... B21F 45/16

[52] U.S. Cl. ..... 140/105; 140/71 R; 72/187

[58] Field of Search ..... 140/71 R, 82, 90, 105; 72/187, 191, DIG. 16

[56] References Cited

U.S. PATENT DOCUMENTS

| | | | |
|---|---|---|---|
| 2,737,212 | 3/1956 | Huszar | 140/105 |
| 2,868,236 | 1/1959 | Smith | 140/105 |
| 3,566,927 | 3/1971 | Adams | 140/82 |

*Primary Examiner*—Lowell A. Larson

*Attorney, Agent, or Firm*—Harness, Dickey & Pierce

[57] ABSTRACT

A pair of die rolls of novel construction are disclosed which act upon a continuous wire having a preliminary zig zag formation in order to impact the bends in the wire and thus narrow the formation, preparatory to use of the wire as a ring binder. Each roll has a continuous spiral groove with a first section of progressively narrowing width which is substantially wider than the wire bend which it accommodates, and a second section of constant width. A knob or projection is formed on at least one side wall of the groove in each roll at the juncture of the first and second sections, which impacts the wire bend as it passes, giving it a set.

3 Claims, 5 Drawing Figures

MACHINE FOR MANUFACTURING ZIG ZAG WIRE BINDERS

BACKGROUND OF THE INVENTION

1. Field of the Invention

The invention relates to apparatus for the manufacture of zig zag wire ring binders in which a continuous wire has oppositely extending legs connected by relatively wide bends at one end and relatively narrow bends at the other, the wire passing through holes in the sheets being bound. The invention is particularly concerned with the formation of this binder at a point after its preliminary zig zag shape has been formed.

2. Description of the Prior Art

Brook et al. U.S. Pat. No. 3,064,694 shows a wire forming machine in which a pair of companion rolls receive a wire having a preliminary zig zag formation. These rolls have grooves decreasing in width and pitch toward the ends of the rolls to squeeze the bends of the zig zag wire into closer formation. A drawback of this previous construction is the fact that considerable friction is created between the wire bends and the narrowing grooves, as these grooves attempt to continuously deform the wire bends received therein. It has been found that this high friction not only detracts from the efficiency of operation of the device, but tends in some cases to bend the opposite ends of the wire down past the bottom support plate disposed between the companion die rolls, thus creating unwanted deformation of the wire.

BRIEF SUMMARY OF THE INVENTION

It is an object of the present invention to provide a novel and improved apparatus for the formation of zig zag wire binders which overcomes the above described drawback of the Brook et al. construction, and achieves the desired bending of the wire with a minimum of friction and unwanted deformation.

It is another object of the invention to provide a novel and improved die roll construction for a wire binder forming machine which insures that the oppositely extending legs of the binder are not unnecessarily bowed out after deformation, but instead are relatively straight, thus creating a well-formed ring binder.

Briefly, the wire binder forming machine of this invention comprises a pair of companion die rolls for receiving the oppositely facing bends of a wire with a preliminary zig zag formation, the groove on each die roll having a helical configuration with a first section of progressively decreasing width and a second section of constant width, the groove side walls of the first section being initially spaced apart a substantially greater distance than the size of the wire bend received therein and progressively narrowing down to approximately the size of the wire bend, the second section having side walls spaced apart approximately the size of the wire bend received therein so as to avoid substantial friction thereon, and a projection formed on at least one side wall of each groove at the juncture of said first and second sections, the size of said projection being such that when it reaches the wire bend it will impact the bend to bring the wire legs extending from the bend closer together.

DESCRIPTION OF THE PREFERRED EMBODIMENT

Figure 1:
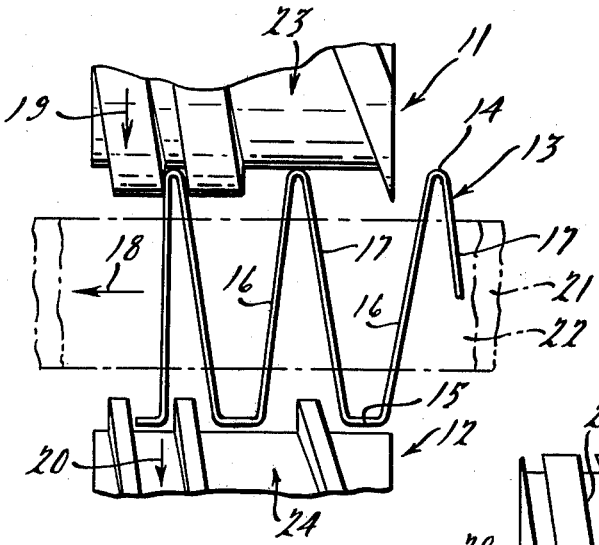
FIG. 1 is a plan view showing portions of the two companion die rolls and the bottom support plate with the wire resting thereon.
Figure 2:
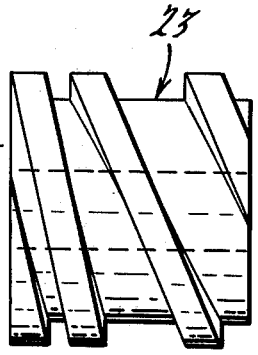
FIG. 2 is a side elevational view of the die roll for the narrower bend.

The die rolls of this invention are generally indicated at 11 and 12 and are intended to operated on a wire generally indicated at 13 which has been given a preliminary zig zag shape, for example, by mechanism shown in the above mentioned Brook et al. patent. The wire 13 is intended in its final shape to have an alternating series of narrow and wide bends 14 and 15, connected by legs 16 and 17. Bend 14 is narrower than bend 15 and legs 16 and 17 extend from each narrow bend 14 toward the wider bends. For purposes of the description, leg 16 may be referred to as a leading leg and leg 17 as a trailing leg as the zig zag wire advances in the direction of the arrow 18 shown in FIG. 1 through the companion die rolls which rotate in the same direction as shown by arrows 19 and 20. A bottom support plate 21 and top guide 22 are disposed between rolls 11 and 12 and hold wire 13 flat as it passes between the rolls.

Roll 11 is provided with a helical groove generally indicated at 23 and roll 12 with a groove generally indicated at 24. Each groove has a first section which receives the wire first, and a second section from which the wire exits at the other end of the roll. The first section of groove 23 is indicated at 25 in FIG. 3 and is of progressively decreasing width, with the leading side wall 26 of the groove having a predetermined pitch and the trailing side wall 27 a substantially greater pitch. The initial portion of groove section 25 is considerably wider than wire bend 14, but the final portion is approximately the same width as bend 14.

Figure 3:
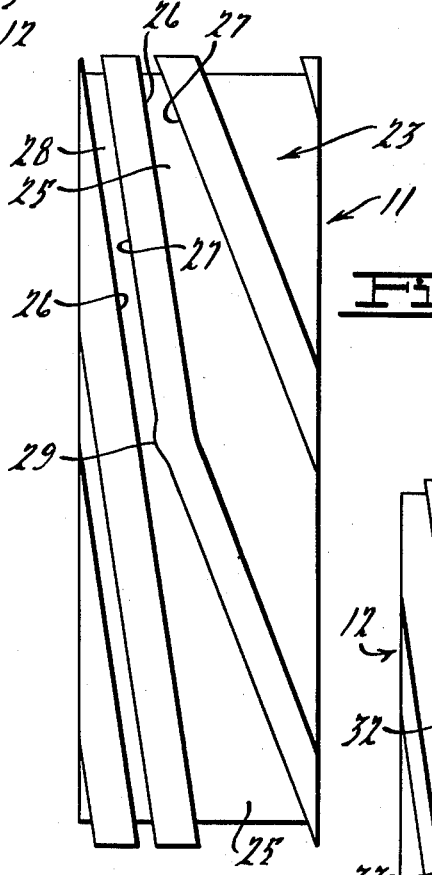
FIG. 3 is a diagrammatical developed view of the die roll of FIG. 2.
Figure 4:
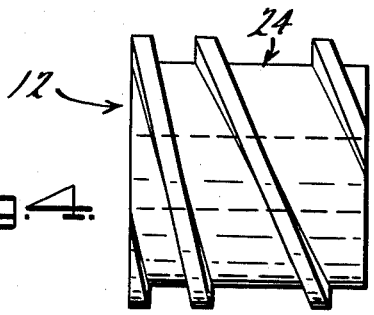
FIG. 4 is a view similar to FIG. 2 but showing the die roll for the wider bend.

The second section of groove 23 is indicated at 28 in FIG. 3 and is of constant width. To form this section of the groove, leading side wall 26 stays at the same pitch as before, but trailing side wall 27 is of lesser pitch than before, being parallel to the leading side wall.

A projection 29 is formed at the juncture of groove sections 25 and 28, as seen in FIG. 3 in exaggerated form. This projection is illustrated as being on trailing side wall 27 and may be formed by any appropriate means such as spot welding. The projection is rounded on both ends so as to blend into the adjacent portions of the trailing side wall. The height of projection 29 is such that when the rotating die reaches advancing bend 14 it will impact the bend and then release it, giving it a set without any prolonged frictional effect on the wire.

Figure 5:
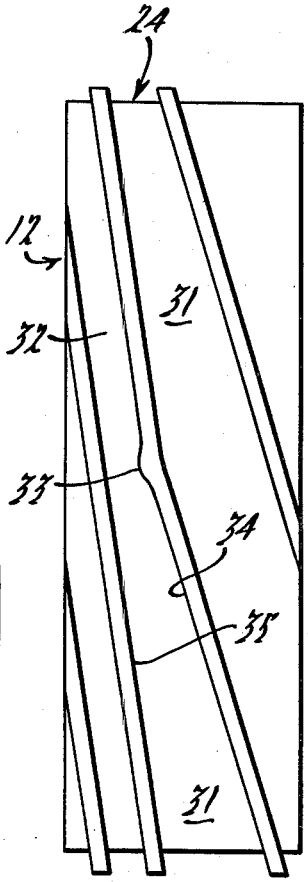
FIG. 5 is a view similar to FIG. 3 but for the roll shown in FIG. 4.

Groove 24 of roll 12, for wider bend 15 of the wire, is formed analogously to groove 23 although it is wider. In particular, groove 24 has a first section 31 of progressively decreasing width as seen in FIG. 5 and a second section 32 of constant width from which the wire exits. Here again, the initial portion of groove section 31 will be considerably wider than bend 15, but the final portion will be approximately the same width. A projection 33 is formed on trailing side wall 34 of the groove at the juncture of sections 31 and 32. The projection is so dimensioned as to create an impact without continued frictional force on bend 15, giving this bend a set. The remaining section 32 will move the wire in the direction of arrow 18 but without excessive friction. Leading side wall 35 of groove 24 is of constant pitch in both sections 31 and 32, whereas trailing side wall 34 is of a greater pitch than section 31 and parallel to side wall 35 in section 32.

In operation, the zig zag wire will be advanced in the direction of arrow 18 by the rotating die rolls engaging the wire, and more particularly their groove sections 28 and 32 advancing the bends in the wire as the wire is held between support 21 and guide 22. As each new bend reaches the entrance portion of its respective die roll, it will be loosely received in the groove until that bend reaches the projection 29 or 33. The sharp impact received by the bends at these projections will bring legs 16 and 17 closer together by creating a substantial set in the wire bends. Thereafter however, as the bends travel through the second sections of the grooves, they will not be subjected to continuous or excessive friction because these grooved sections are of constant width.

In addition to the advantage described above of minimizing the tendency of the outsides of the zig zag wire to be bent, it has been found that the above described die roll construction achieves more accurately bent legs in the sense that any bellying or bowing of legs 16 and 17 is minimized. Instead, the legs will have a straighter appearance after leaving the die rolls. This is believed to be the result of the momentary impact imparted to the bends instead of the continuous and progressive squeezing action of the construction of the above-identified Brook et al. patent.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A wire binder forming machine comprising a pair of companion die rolls for receiving the oppositely facing bends of a wire with a preliminary zig zag formation, the groove on each die roll having a helical configuration with a first section of progressively decreasing width and a second section of constant width, the groove side walls of the first section being initially spaced apart a substantially greater distance than the size of the wire bend received therein and progressively narrowing down to approximately the size of the wire bend, the second section having side walls spaced apart approximately the size of the wire bend received therein so as to avoid substantial friction thereon, and a projection formed on at least one side wall of each groove at the juncture of said first and second sections, the size of said projection being such that when it reaches the wire bend it will impact the bend to bring the wire legs extending from the bend closer together.

2. The combination according to claim 1, each groove having a leading and a trailing side wall, the leading side wall being of constant pitch, the first section of said trailing side wall having a relatively steeper pitch, said projections being formed at the junctures of the first and second sections of said trailing side walls.

3. The combination according to claims 1 or 2, the section section of one of said rolls being wider than that of the other to accommodate a wider bend in the wire.

* * * * *

UNITED STATES PATENT AND TRADEMARK OFFICE

CERTIFICATE OF CORRECTION

PATENT NO. : 4,178,972

DATED : December 18, 1979

INVENTOR(S) : Ernst Pfaffle

It is certified that error appears in the above-identified patent and that said Letters Patent are hereby corrected as shown below:

Column 2, line 18, "operated" should be --operate--;

Column 4, line 33, "section" (first occurrence) should be -- second --.

Signed and Sealed this

*First* Day of *April 1980*

[SEAL]

*Attest:*

SIDNEY A. DIAMOND

*Attesting Officer*

*Commissioner of Patents and Trademarks*